US007794376B2

(12) United States Patent
Chou

(10) Patent No.: US 7,794,376 B2
(45) Date of Patent: Sep. 14, 2010

(54) AB-EXERCISER BENCH

(75) Inventor: Cheng I. Chou, Prarie View, IL (US)

(73) Assignee: Body Solid, Inc., Forrest Park, IL (US)

( * ) Notice: Subject to any disclaimer, the term of this patent is extended or adjusted under 35 U.S.C. 154(b) by 1 day.

(21) Appl. No.: 12/290,874

(22) Filed: Nov. 4, 2008

(65) Prior Publication Data

US 2009/0118104 A1 May 7, 2009

Related U.S. Application Data

(60) Provisional application No. 61/001,827, filed on Nov. 5, 2007.

(51) Int. Cl.
*A63B 21/08* (2006.01)
*A63B 23/02* (2006.01)
*A63B 21/068* (2006.01)

(52) U.S. Cl. ..... 482/140; 482/95; 482/97; 482/137; 482/145

(58) Field of Classification Search ..... 482/92–97, 482/100, 137, 140, 142, 145
See application file for complete search history.

(56) References Cited

U.S. PATENT DOCUMENTS

| | | | | |
|---|---|---|---|---|
| 4,387,893 | A * | 6/1983 | Baldwin | 482/137 |
| 4,729,562 | A * | 3/1988 | Pipasik | 482/97 |
| 5,665,041 | A * | 9/1997 | Hsieh | 482/140 |
| 5,938,575 | A * | 8/1999 | Stearns | 482/140 |
| 6,544,154 | B2 * | 4/2003 | Forcillo | 482/142 |
| 6,884,203 | B2 * | 4/2005 | Forcillo | 482/142 |
| 7,384,383 | B2 * | 6/2008 | Forcillo et al. | 482/140 |
| 7,658,701 | B2 * | 2/2010 | Webb et al. | 482/140 |
| 7,670,269 | B2 * | 3/2010 | Webber et al. | 482/94 |
| 7,686,750 | B2 * | 3/2010 | Tuller | 482/142 |
| 2006/0211549 | A1 * | 9/2006 | Nohejl | 482/97 |
| 2007/0287619 | A1 * | 12/2007 | Tuller | 482/140 |
| 2008/0058176 | A1 * | 3/2008 | Webber et al. | 482/94 |
| 2008/0085822 | A1 * | 4/2008 | Webb et al. | 482/140 |
| 2008/0146419 | A1 * | 6/2008 | Chu | 482/96 |
| 2010/0062906 | A1 * | 3/2010 | Abelbeck | 482/51 |

FOREIGN PATENT DOCUMENTS

| | | | |
|---|---|---|---|
| SE | 9403228 A | * | 3/1996 |
| WO | WO 03008047 A2 | * | 1/2003 |

* cited by examiner

*Primary Examiner*—Loan Thanh
*Assistant Examiner*—Victor K Hwang
(74) *Attorney, Agent, or Firm*—Clifford Kraft

(57) ABSTRACT

An abdominal muscle exercise machine that generally contains a diagonal member with an adjustable seat and a backrest and a pivot member that pivots with respect to the diagonal member. A chest push can be mechanically coupled to the pivot member through an adjustable force multiplier. An optional counterweight can be placed near one end of the pivot member to lighten the force, or an optional load weight can be placed near the other end of the pivot member to increase the force. The pivot member can be constructed to telescope or otherwise adjust for different body sizes. The machine provides a smooth exercise where the top and bottom portions of the body move together in a linked fashion. The machine of the present invention works without heavy external weights.

6 Claims, 8 Drawing Sheets

AB-EXERCISER BENCH

This application is related to and claims priority from U.S. Provisional patent application No. 61/001,827 filed Nov. 5, 2007. Application No. 61/001,827 is hereby incorporated by reference.

BACKGROUND

1. Field of the Invention

The present invention relates generally to the field of exercise machines and more particularly to an ab-exerciser bench (for abdominal muscles or abs).

2. Description of the Prior Art

Several muscle exercise machines are known in the art including machines for exercising and shaping up abs (abdominal muscles). For example, Stearns in U.S. Pat. No. 5,938,575 teaches several versions of machines that can accomplish this. Many exercise machines that are designed to exercise the abs use an arrangement where the user lies partially prone or supine with the feet extending between pairs of bars. The user then pulls or pushes an arm handle that works through a pivot mechanism to raise the legs or the body. The user in this case generally works against the weight of his or her body or legs. Some machines have external weights that are also raised in the process.

Many existing prior art machines do not allow adjustment of the arm pull angle, leg-in and leg-out adjustments and may not have counterweights to optionally make the exercise easier or smoother. Also, many prior art machines do not allow the user to work a bar with the chest only so that the exercise concentrates on the ab muscles.

It would be advantageous to have an ab-exerciser machine that it allows the top and bottom portions of the body to move together in a linked fashion along with the machine as opposed to separately one at a time without heavy external weights, and that allows adjustment of arm pull angle in several steps to increase or decrease difficulty of the exercise, allows an in-out adjustment for people of different heights (leg length) and has an optional counterweight to ease the exercise if necessary. It would also be advantageous to have an ab-exerciser machine that allows use of the chest as well as the hands so that the exercise can be concentrated on the ab muscles.

SUMMARY OF THE INVENTION

The present invention relates to an exercise machine designed to allow exercise of abdominal muscles. The machine can include a diagonal bar or channel with an adjustable seat (adjustable up and down the diagonal bar) and a backrest mounted higher on the diagonal bar. The diagonal bar can rest with legs on a flat surface or floor. This diagonal bar or channel can be fixed in position by a front and rear base that engages a flat surface like a floor. The rear part of the base can have an elevated center section that holds the higher part of the diagonal bar. The machine also can have a pivot member that can pivot in relation to the diagonal bar at a pivot point roughly under the adjustable seat. The pivot member generally has a set of foot supports or some other sort of foot engage on one end and can optionally telescope in length to adjust for body size. The pivot member can pass under the elevated center section of the rear legs where it can carry an optional counterweight. A chest push that is roughly horizontal can be attached to the elevated portion of the rear base so that it can move up and down and drive a force-multiplying linkage that links to the pivot member. This linkage can contain an adjustable piece that is attached with an adjustable angle so that the ratio of force multiplication can be adjusted. The linkage can also contain a motion coupler that either attaches directly to the pivot member or attaches through an extension rod or channel. Removable weights can be mounted on the front and back of the pivot member to either increase the load or act as a counterweight lightening the load. Using the machine of the present invention, a user can smoothly exercise abdominal muscles by either pulling on the chest push member causing the legs (and load weight) to lift, lifting the legs, or pushing on the chest push member with the chest.

DESCRIPTION OF THE FIGURES

Attention should be paid to the following figures to illustrate aspects of embodiments of the present invention.

Figure 1:
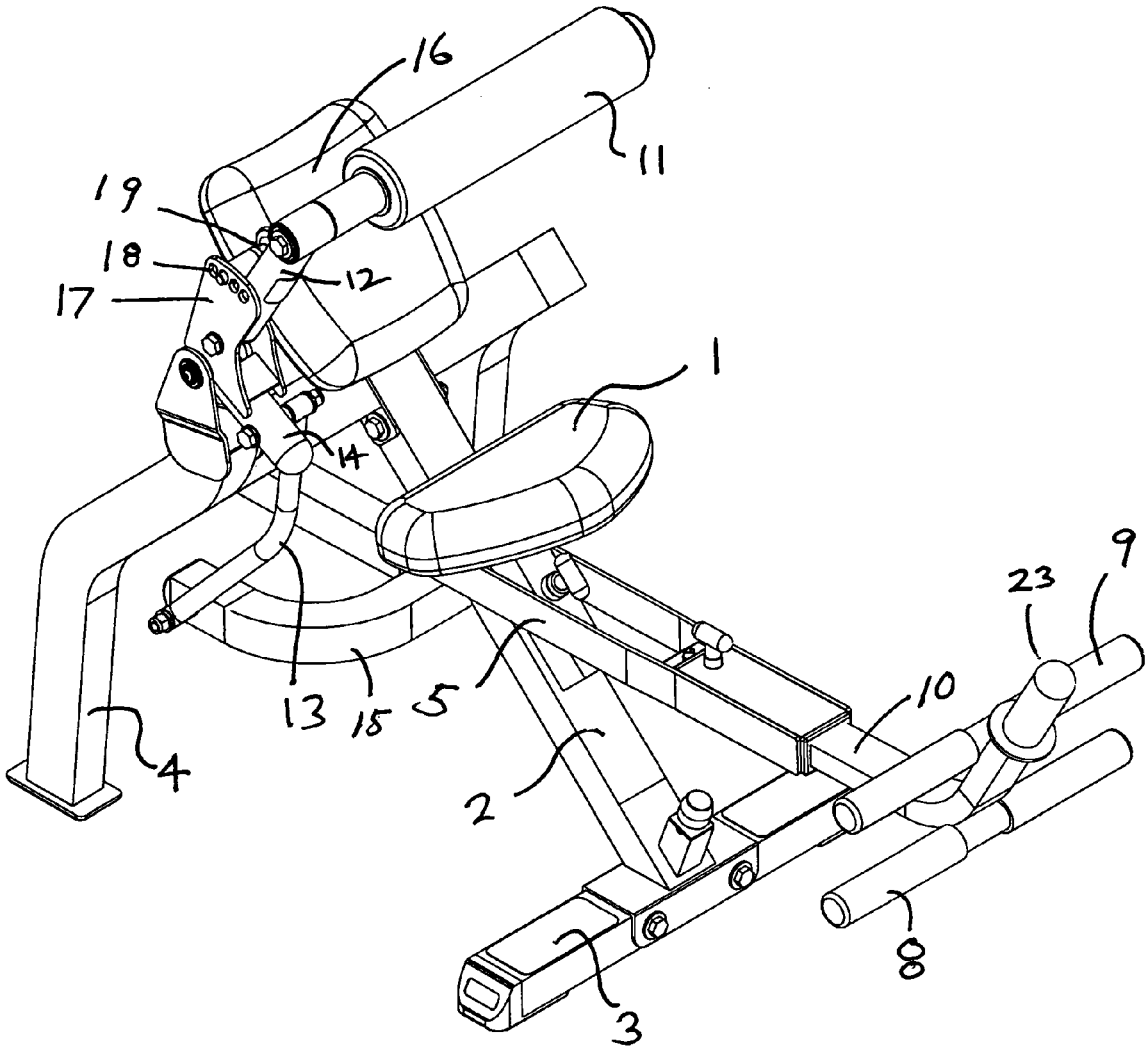
FIG. 1 shows a perspective view of an embodiment of the present invention.

Several drawings and illustrations have been presented to aid in understanding the present invention. The scope of the present invention is not limited to what is shown in the figures.

DESCRIPTION OF THE INVENTION

The present invention relates to an abdominal muscle (ab) exerciser machine that is small and light and does not require the use of heavy lift weights. In addition, the present invention allows the top and bottom portions of the body to move together in a linked fashion along with the machine as opposed to separately one at a time. Turning to FIGS. 1-6, left and right side perspective views of an embodiment of the present invention can be seen. A seat 1 is mounted on a frame 2 that has front legs 3 and rear legs 4. The frame 2 can have a raised center section between the rear legs 4. A pivot member 5, 7 generally pivots at a pivot point 6 (See FIG. 3) so that the lower 8 and upper 9 foot braces that are attached to the end of the pivot member 5 can pivot up and down with the arm. A telescoping or adjustable length extender 10 allows the foot braces 8, 9 to adjust laterally outward to increase the length of the pivot and allow for taller or shorter people to use the device. A chest push 11 can be attached to the frame 2, through a lever 14 that is free to pivot. An extension rod 13 can tie the lever member 14 to the pivot member 5, 7. Through this arrangement, when the chest push 11 is pushed forward, a motion coupler 12 can engage the lever 14 through a pin 19 and plate 17 or other mechanism and cause the extension rod 13 to push downward on the pivot member 5, 7, either directly or through an extension 15 so that it can pivot against the weight of the user's legs and feet. The motion coupler 12 is also optional and can be used to push the lever 14 so that the motion of the chest push 11 is improved. Also a motion coupler can be used to set up different initial positions that allow various users to start at different chest push member positions and hence change the force-multiplying characteristic of the machine. The extension rod 13 can be attached to the pivot member 5, 7 either directly or using an optional extended part 15 of the pivot member 5, 7.

Figure 2:
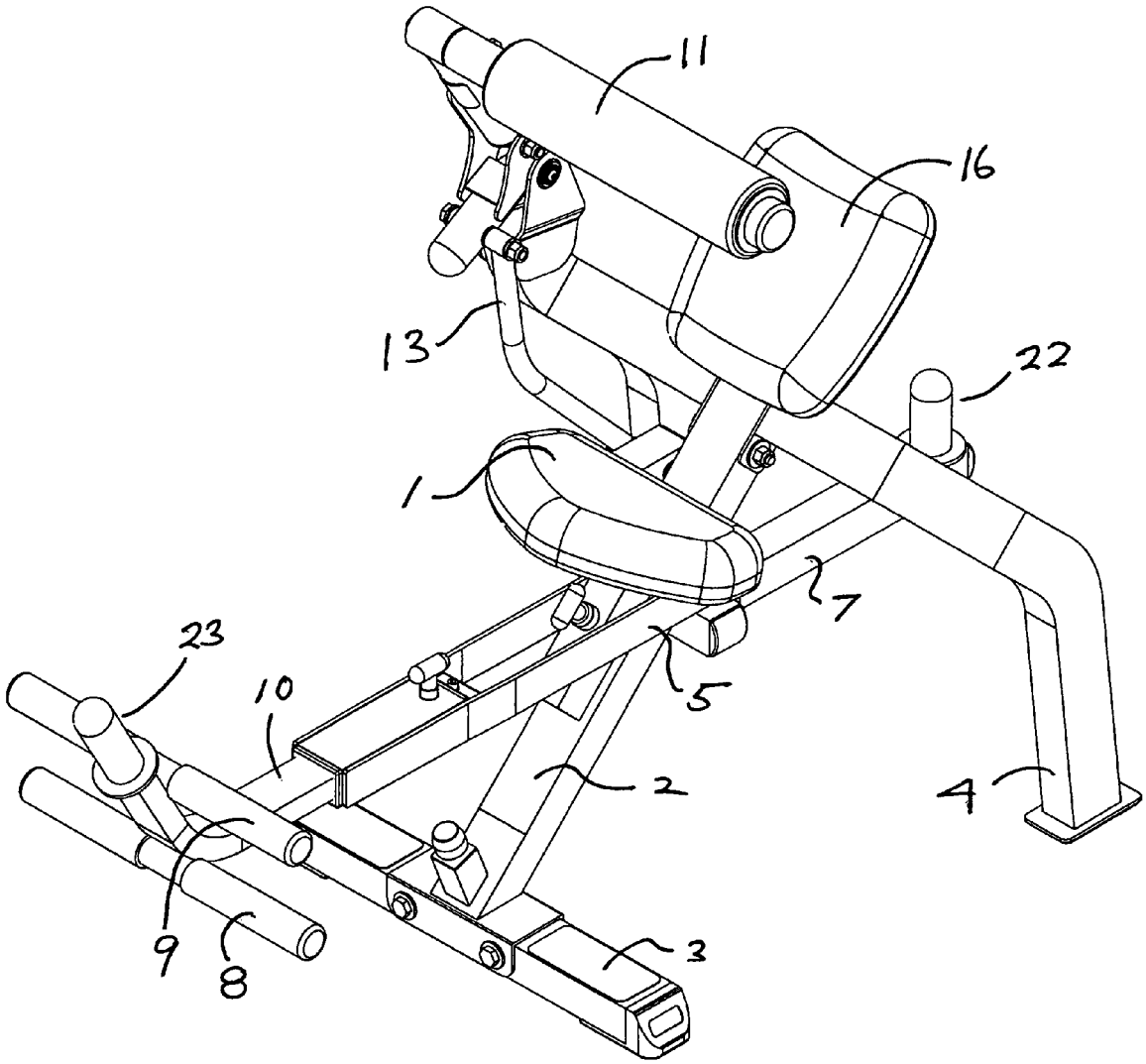
FIG. 2 shows a perspective view from the opposite side.

FIG. 2 shows a counter weight mounting location 22 on the rear of the pivot member 7. A counterweight can be used to make the exercise smoother. A mounting location 23 for a forward weight can also be see on the adjustable length extender 10. A weight in this location increases the force of the exercise. The counterweight 20 is shown mounted in FIG. 8, and a forward weight 21 is shown mounted in FIG. 7.

Figure 5:
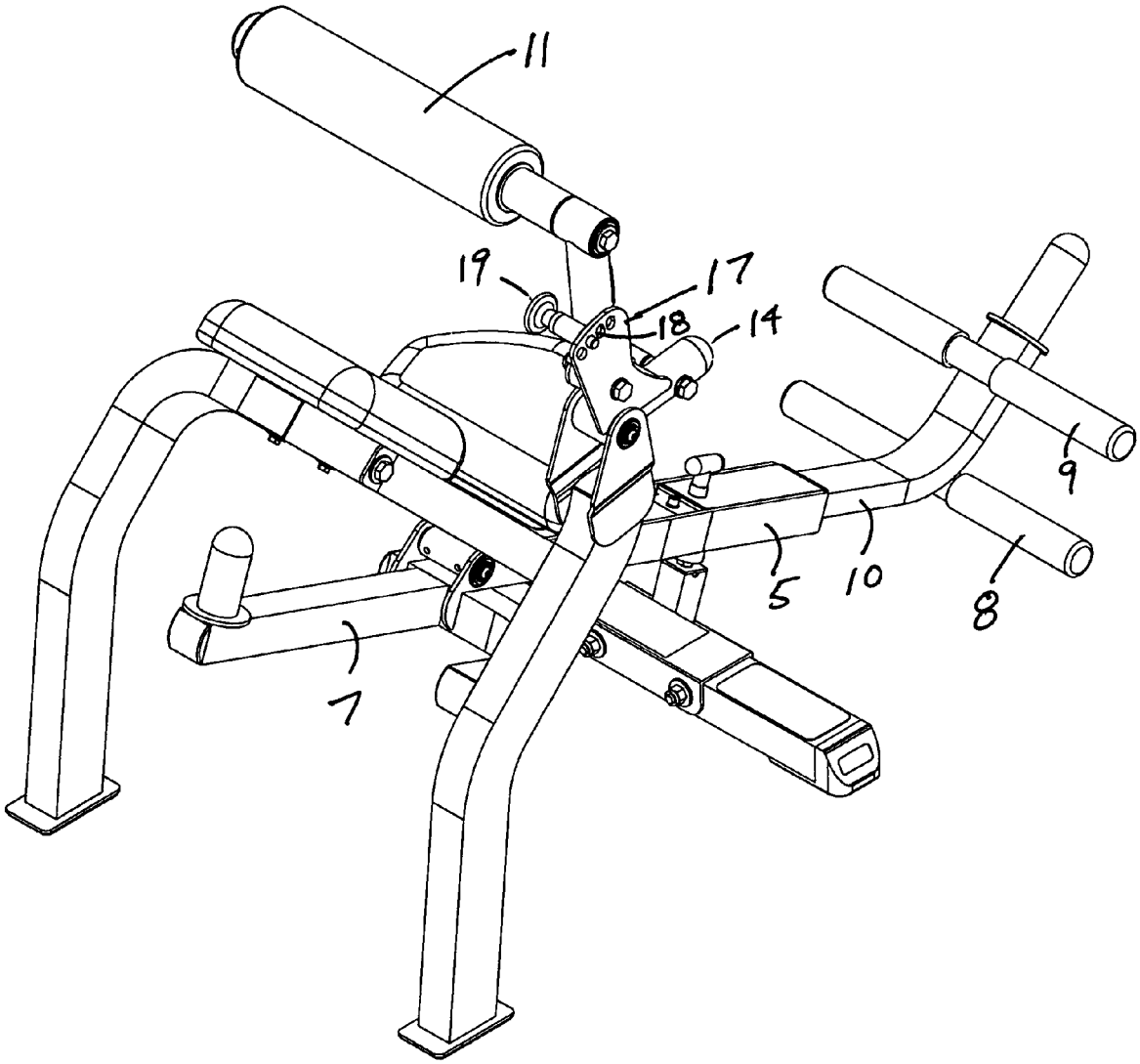
FIG. 5 shows a perspective view from the back.
Figure 6:
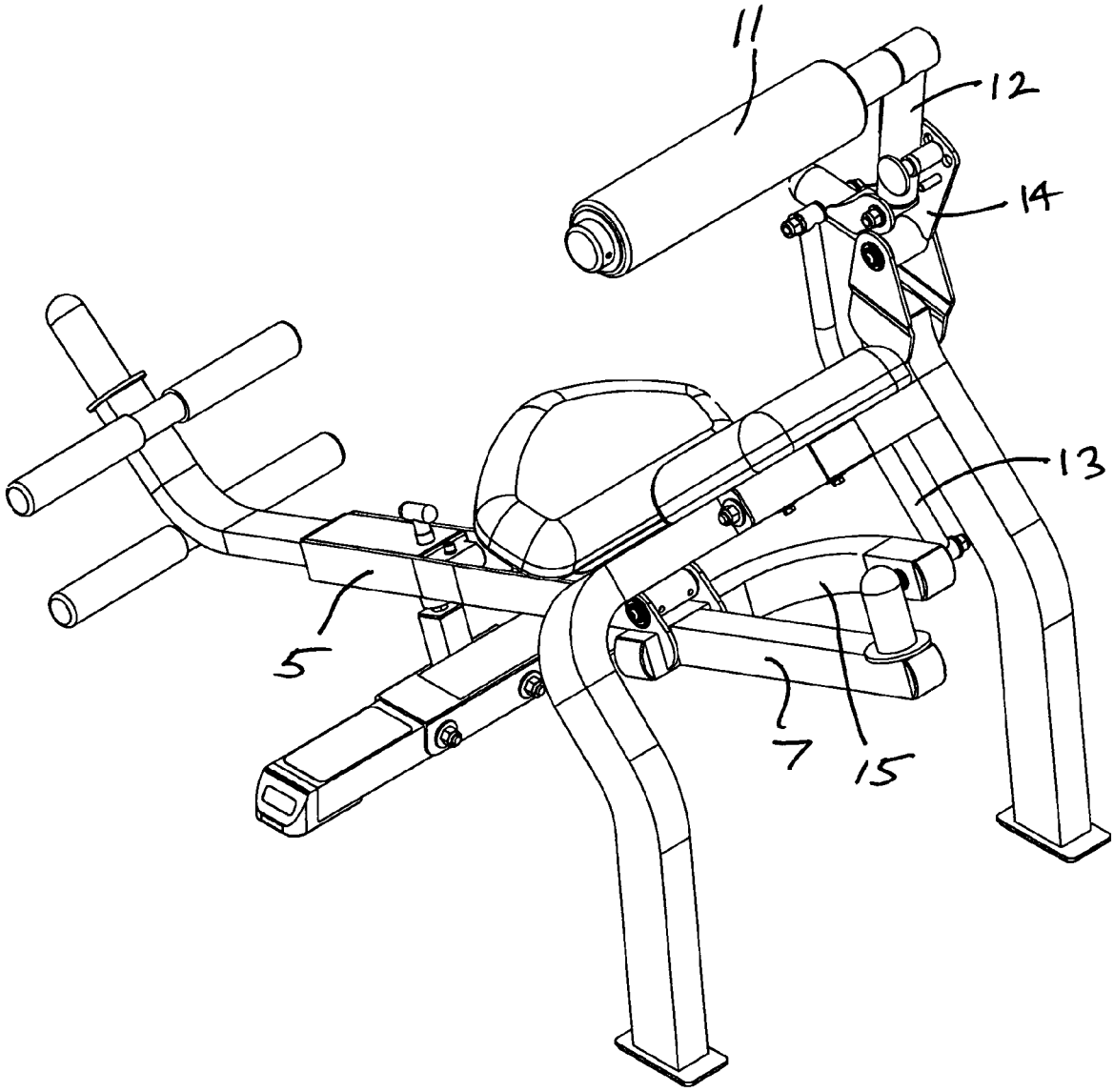
FIG. 6 shows a perspective view from the opposite side of the back.

Turning to FIG. 1 and FIG. 5, it can be seen that the upper part of the lever 14 can have a flange or plate 17 with several holes 18 that allow adjustment of the lifting force required by setting a pin 19 in a particular hole. The combination of the lever 14 and the motion coupler 12 results in a force multiplier with an adjustable force ratio.

It should be noted that FIGS. 1-6 show a preferred embodiment of the present invention. Numerous other embodiments are possible.

Figure 3:
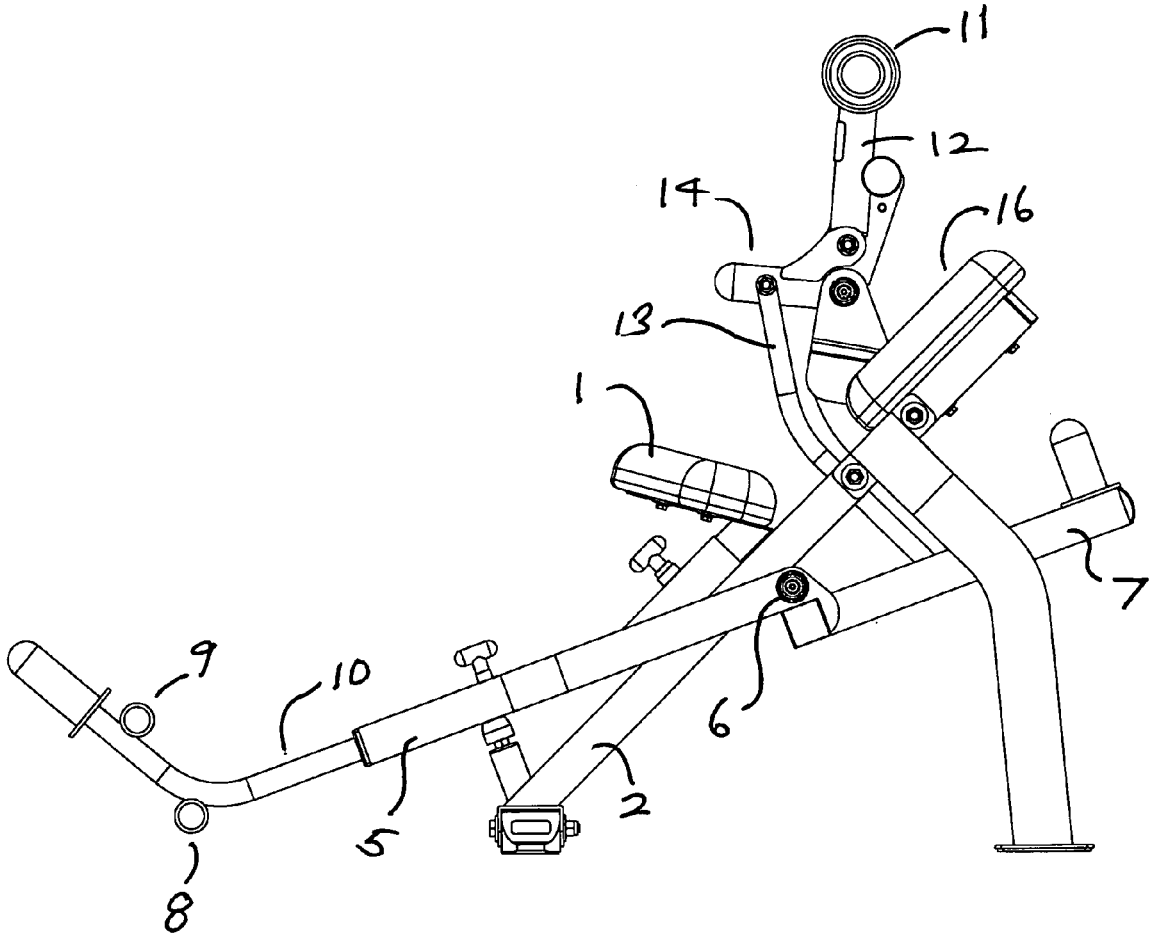
FIG. 3 shows a side view with the pivot member in a lower position.
Figure 4:
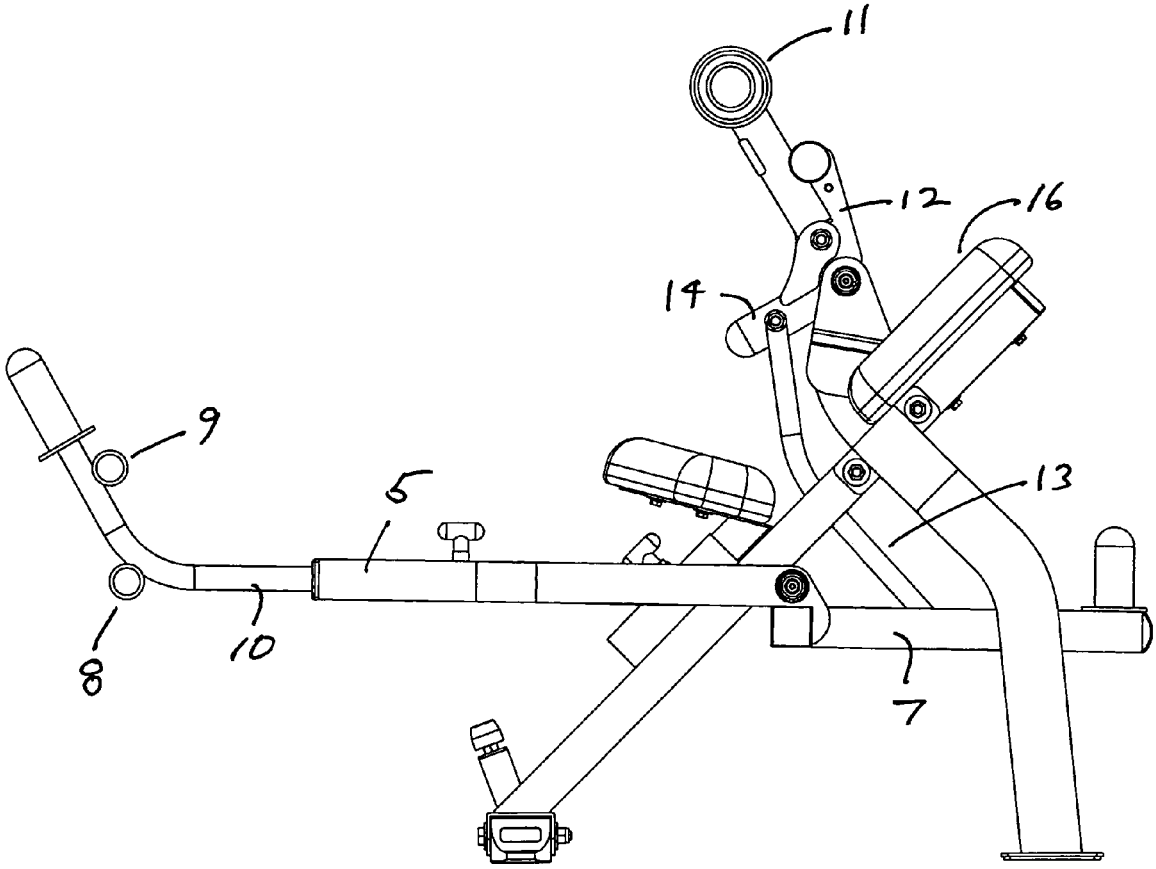
FIG. 4 shows a side view with the pivot member in a raised position.

To use the invention, the user sits on the lower seat 1, and rests the back against the upper pad 16 and inserts his or her feet between the upper and lower foot rails 8, 9 or under 8 as well. The pivot member 5, 7 will move with the upper lever 14 simultaneously through the extension rod 13 which links the pivot member 5, 7 and the lever 14. To exercise, the user pushes outward on the chest push 11 causing the legs to rise, or the user raises the legs to push the chest push 11 outward. The user's body weight provides the resistance to exercise by either raising the legs with the pivot member 5 or pushing the chest push 11. FIG. 3 shows a side view of the device in a lower position, and FIG. 4 shows a side view of the device in an upper position. An exercise that strengthens the abs consists of alternately raising and lowering the legs using the chest push 11.

Figure 7:
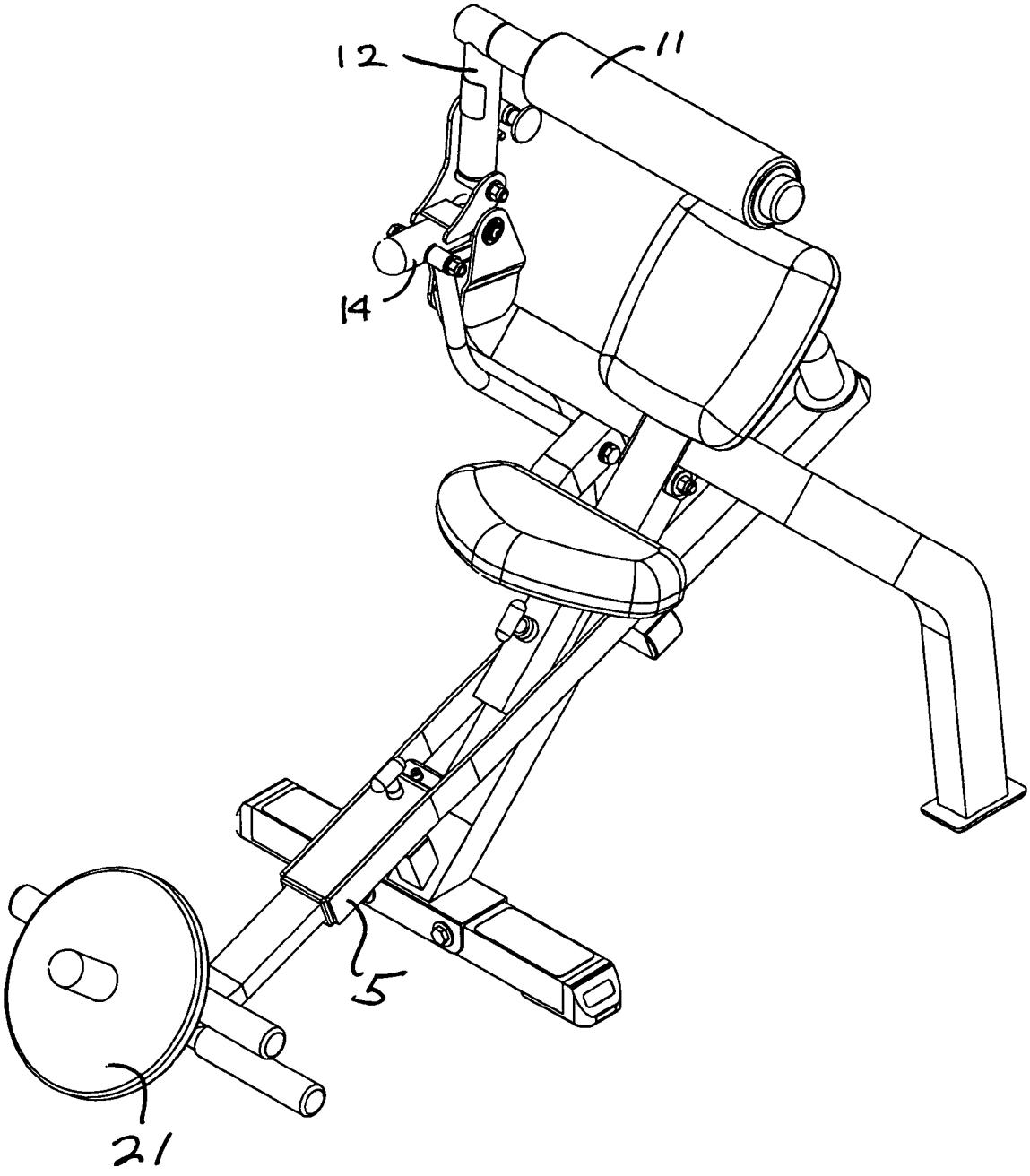
FIG. 7 shows use of a load weight.
Figure 8:
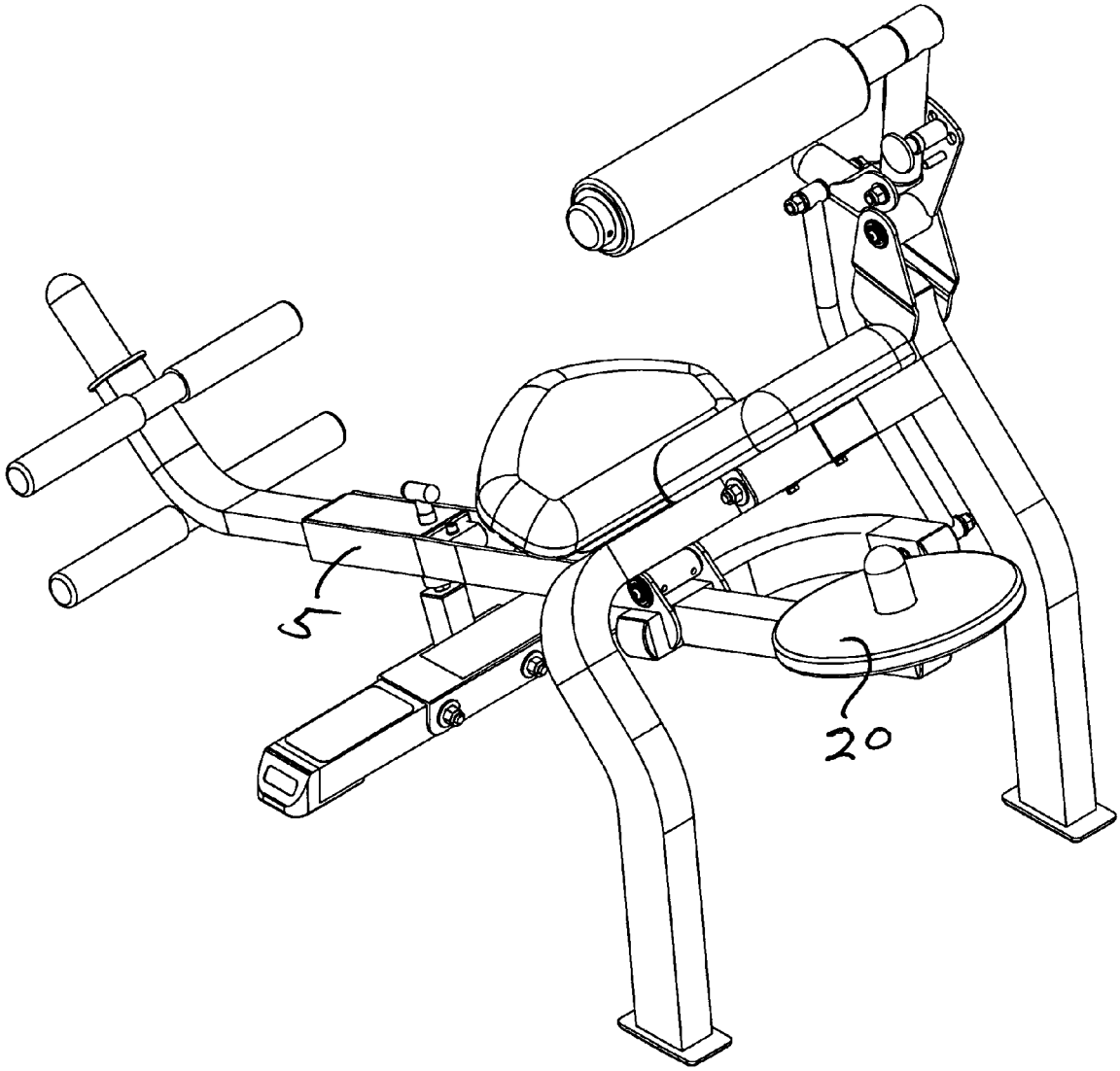
FIG. 8 shows use of a counterweight.

As has been stated, one or more optional movable weights may be used to smoothen or increase the exercise. FIGS. 7-8 show the use of such a weight. In FIG. 7, a force-increasing weight 21 is shown mounted on the tip of the pivot member on a post 22 (FIG. 2) just forward of the user's feet. In this position, the weight 21 increases the exercise by requiring the user to lift the weight in addition to the weight of the legs and feet. In FIG. 8, a counterweight 20 is shown mounted on a post 23 (FIG. 2) on the aft end of the pivot member 5. In this position, the weight 20 acts as a counterweight to lighten the exercise.

Several descriptions and illustrations have been provided to aid in understanding the present invention. One skilled in the art will realize that numerous changes and variations can be made without departing from the spirit of the invention. Each of these changes and variations is within the scope of the present invention.

I claim:

1. An exercise machine for exercising abdominal muscles comprising:

a base supporting said machine on a relatively flat surface including a rear part, center part and a front part, said rear part having two feet engaging said flat surface and an elevated center portion, said front part being lower than said rear part having either a bar directly engaging said flat surface or a bar with one or more feet engaging said floor, said center part including a diagonal member running from a top end proximal to said elevated center portion of said rear part to said front part, said seat being attached to said diagonal member at approximately a middle point of the diagonal member, and a backrest attached to said diagonal member at the top end of the diagonal member that is proximal to the elevated center portion of the rear part of the base;

a pivot member attached to said diagonal member at a pivot point, said pivot member having a front part including a set of foot bars and a mounting for a removable weight, said pivot member also having a rear part with a mounting for a removable counterweight;

a generally horizontal chest push member located above said seat and pivotally attached to said rear part of said base and also mechanically coupled through a force-multiplying linkage to said pivot member;

wherein pushing on said chest push member causes said pivot member to pivot so that said foot bars pivot upward, and wherein said force-multiplying linkage is adjustable to provide a plurality of different force ratios.

2. The exercise machine of claim 1 wherein said seat is adjustable.

3. The exercise machine of claim 1 wherein said front part of said pivot member telescopes.

4. The exercise machine of claim 1 wherein said force-multiplying linkage includes a lever member and a motion coupler both pivotally attached to said elevated center portion of said rear part of said base, said lever member and said motion coupler being connected together by a plate and pin mechanism, and wherein said motion coupler is attached to said chest push member, and said lever member is pivotally attached to a connecting rod on a first end of said connecting rod, said connecting rod being attached to said pivot member directly or through an extension channel on a second end of said connecting rod.

5. The exercise machine of claim 4 wherein said plate and pin mechanism is adjustable to different angles to provide an adjustable force ratio.

6. The exercise machine of claim 5 wherein said plate and pin mechanism is adjustable by a plate containing a plurality of holes attached to said lever member and a pin penetrating one of said holes attached to said motion coupler.

* * * * *